US006537935B1

(12) United States Patent
Seth et al.

(10) Patent No.: US 6,537,935 B1
(45) Date of Patent: Mar. 25, 2003

(54) HIGH STRENGTH NONWOVEN FABRIC AND PROCESS FOR MAKING

(75) Inventors: Jayshree Seth, Woodbury, MN (US); William Melbye, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/240,452

(22) Filed: Jan. 29, 1999

(51) Int. Cl.[7] ..... D04H 3/03

(52) U.S. Cl. ..... 442/366; 442/328; 442/333; 428/92; 428/152; 428/195; 428/196; 428/198; 428/298.1; 604/373; 604/385.2

(58) Field of Search ..... 442/328, 333, 442/366; 604/373, 385.2; 428/198, 298.1, 92, 152, 195, 196

(56) References Cited

U.S. PATENT DOCUMENTS 4,931,355 A * 6/1990 Radwanski et al. ..... 428/283
5,681,302 A * 10/1997 Melbye et al. ..... 604/373
5,705,249 A * 1/1998 Takai et al. ..... 428/94
6,096,016 A * 8/2000 Tsuji et al. ..... 604/378

FOREIGN PATENT DOCUMENTS

EP 0 289 198 11/1988
EP 0 792 629 A2 9/1997

* cited by examiner

*Primary Examiner*—Terrel Morris
*Assistant Examiner*—John J. Guarriello
(74) *Attorney, Agent, or Firm*—Gary L. Griswold; Robert W. Sprague; William J. Bond

(57) ABSTRACT

A nonwoven fabric sheet comprising a multiplicity of generally parallel elongate strands of inelastic thermoplastic material extending in a first direction in spaced relationship, each of said strands having opposite elongate side surface portions that are spaced from and are adjacent elongate side surface portions of adjacent strands, and each of said strands also having corresponding opposite first and second elongate surface portions extending between said opposite elongate side surface portions, and a first sheet of flexible nonwoven material having spaced anchor portions bonded at first bond sites of the strands along said first elongate surface portions wherein the elongate strands thermoplastic material is oriented at least between adjacent bond sites along the length of the strands.

13 Claims, 6 Drawing Sheets

HIGH STRENGTH NONWOVEN FABRIC AND PROCESS FOR MAKING

TECHNICAL FIELD

The present invention relates to high strength nonwoven fabric having at least one sheet of flexible nonwoven material intermittently bonded to inelastic filaments. The invention further relates to methods for producing these nonwoven reinforced fabrics in which fibrous webs of low strength are joined to high strength filaments as reinforcing elements.

Nonwoven materials having reinforcing elements are well known in the art. Scrims or like reinforcing webs are often joined to low strength nonwoven webs or fabrics by one of a variety of attachment methods including binders, adhesives, heat or sonic bonding, hydroentanglement or the like. For example, U.S. Pat. No. 4,522,863 describes taking a scrim of crosslaid threads coated with a heat reactable plastisol adhesive and bonds this to a microfiber web, preferably formed by meltblowing. Binders are used in U.S. Pat. No. 4,634,621 to join nonwoven webs to scrims such as Kevlar™ or Nomex™ fabrics. In U.S. Pat. No. 5,691,029, a yarn is bonded to a nonwoven, preferably in a crosshatched pattern. Heat bonding is used in a pattern to bond a microfiber nonwoven to a spunbond scrim in U.S. Pat. No. 4,041,203. A more complete full calendaring is used in U.S. Pat. No. 4,931,355 to join a nonwoven fibrous non-elastic web to a screen, scrim, netting, knit or woven. Hydroentangling also is used in U.S. Pat. No. 4,810,568 to join a nonwoven to a scrim netting. The above applications all employ relatively high strength material joined to a low strength nonwoven web resulting in a web that generally has the strength, flexibility, and other bulk web properties of the high strength material. As such, desirable web properties of the lower strength nonwoven are generally lost, such as flexibility or conformability. This is due to the fact that conventional reinforcement materials are sheet-like materials, as such the sheet or web properties of the composite are dominated by the reinforcement material layer. The composite however will still have surface or bulk properties of an outer nonwoven layer, such as coefficient of friction or absorbency, respectively.

U.S. Pat. No. 5,705,249 discloses bonding filaments to the surface of a nonwoven web. These filaments are pattern bonded by point bonding. This results in bulking of the composite in the area between the point bond sites. This bulking behavior allegedly decreases the slipperiness in comparison to a prior product where the nonwoven was point bonded to a film-like product. This product is complicated to manufacture and the filaments are relatively low strength unoriented type filaments.

It has also been proposed to orient nonwoven webs as a way to provide increased strength in the orientation direction without effecting the softness of the web, U.S. Pat. No. 4,048,364. The fibers forming the web align and provide increased tenacity in this direction of alignment. This process, however, adversely effects the loft and tactile properties of the nonwoven web and does not provide the strength obtainable with a high strength scrim. Also, this process is limited to nonwoven webs having some interfiber bonding or integrity, but not so much that it is filmlike.

Reinforcing scrims or films have also been incorporated into nonwoven web structures or laminates designed for particular end uses. For example, U.S. Pat. No. 5,256,231 describes forming a non-woven or fibrous loop material by corrugating either a non-woven web or a series of substantially non-parallel yarns in a corrugating nip and subsequently extrusion bonding a thermoplastic film onto specific anchor portions of the sheet of corrugated fibrous material.

U.S. Pat. Nos. 5,326,612 and 5,407,439 describe forming loop fastening material from non-woven materials such as spunbond webs lightly bonded to a structural backing. In U.S. Pat. No. 5,326,612, the total bond area (between the fibers of the loop fabric and between the loop fabric and the backing) is between 10 and 35 percent to allow for sufficient open area for the hooks to penetrate. The backing allegedly could be a film, a woven material or a nonwoven but should not allow the hooks to penetrate. In U.S. Pat. No. 5,407,439 the loop fabric (the entanglement zone) is laminated to a material(spacing zone) that permits hooks to penetrate but does not preferably entangle the hooks with a further optional backing layer that does not permit hook penetration. The spacing zone is generally thicker than the entanglement zone such that a hook will not fully penetrate through it. Low bonding levels are desired for these loop fastener applications, as is dimensional stability.

Japanese Pat. Publ. No. 7-313213 describes a loop fastening material formed by fusing one face of a non-woven loop fabric. The fabric is formed by entanglement of sheath-core composite fibers having a polyethylene sheath and a polypropylene core. Generally, the fibers are described as having a diameter of from 0.5 to 10 denier with the nonwoven web having a basis weight of from 20 to 200 grams per square meter. The fused face provides reinforcement but this has also adversely affects the softness and flexibility of the fabric.

BRIEF DISCLOSURE OF THE INVENTION

The present invention provides improved inelastic, dimensionally stable, high strength nonwoven fabric sheets comprising a multiplicity of elongate strands of inelastic material extending generally continuously in at least a first direction and one or more sheets of flexible nonwoven material intermittently bonded along at least one elongate surface portion of the inelastic oriented strands. These sheets of nonwoven fabric are not easily extensible, in at least the first direction, due to the elongate strands. Preferably, the sheets have regular spaced bond portions between the nonwoven material and the strands. These intermittent bond anchor portions are separated by unbonded portions where the strand and nonwoven face each other, but not bonded. These composites provide unique advantages as a low cost, flexible or soft, dimensionally stable, breathable nonwoven fabric sheet which is relatively simple to manufacture.

According to the present invention there is also provided a method for forming a nonwoven fabric sheet which comprises (1) providing a first sheet of flexible nonwoven material (e.g., nonwoven web of natural and/or polymeric fibers, and/or yarns); (2) forming the first sheet of flexible nonwoven material to have arcuate portions projecting in the same direction from spaced anchor portions of the first sheet of flexible nonwoven material; (3) extruding or providing spaced generally parallel elongate strands of thermoplastic material that is inelastic (e.g., polyester, polyolefin, nylons, polystyrenes) onto the first sheet of flexible loop material; (4) providing the inelastic strands as a molten mass at least at the spaced anchor portions of the first sheet of flexible nonwoven material to thermally bond the strands to the nonwoven material at bond sites or the anchor portions (the strands extend between the anchor portions of the sheet of flexible nonwoven material with the arcuate portions of the first sheet of flexible material projecting from corresponding elongate surface portions of the strands); and (5) orienting the nonwoven fabric sheet in the longitudinal direction of the strands thereby orienting the strands and reducing or eliminating the arcuate portions. By this method there is provided a novel sheet-like nonwoven composite comprising a flexible nonwoven intermittently bonded to a multiplicity of generally parallel oriented elongate strands of inelastic thermoplastic material extending in one direction in a generally continuous parallel spaced relationship.

BRIEF DESCRIPTION OF DRAWINGS

The present invention will be further described with reference to the accompanying drawing wherein like reference numerals refer to like parts in the several views, and wherein.

DETAILED DESCRIPTION OF THE INVENTION

Figure 1:
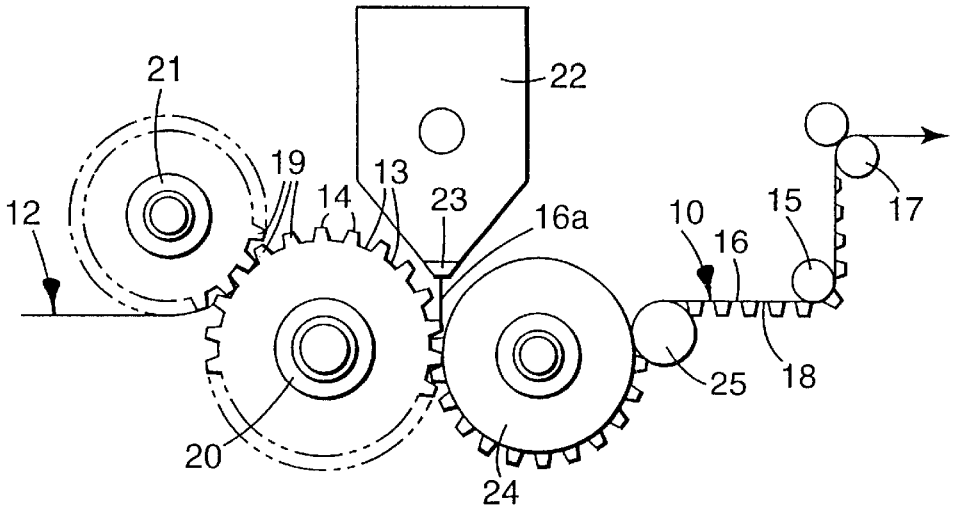
FIG. 1 is a schematic view illustrating a first embodiment of a method and equipment for making a first embodiment of a nonwoven fabric sheet according to the present invention.

The invention composite nonwoven fabric sheet is preferably formed by extruding inelastic strands onto anchor portions of a first sheet of flexible nonwoven material formed to have arcuate portions extending from the anchor portions followed by orientation to provide a strengthened nonwoven. The molten strands form around arcuate surfaces of the anchor portions creating bond sites. The molten strands can form bond sites along all or a part of the strand length where there are anchor portion, (e.g., a flat portion of the nonwoven material). The solidified inelastic strands have a generally uniform morphology along their lengths including at the bond sites prior to orientation. The strands can be pressed against the anchor portions at the bond sites increasing the strand width transverse to the length of the strands (the first direction) which increases the bond strength or attachment area between the sheet and the strands along a first elongate surface portion of the strands. If the strands have flexible nonwoven material attached to only one elongate surface portion the compression and consequential widening of the strands also provides greater surface area for attachment of the nonwoven fabric sheet strands on the second elongate surface portions to a further substrate.

A method for forming a nonwoven fabric sheet with arcuate nonwoven structures between spaced apart bond sites comprises a step of forming the arcuate nonwoven material, which can comprise the following steps. (1) There is provided first and second generally cylindrical corrugating members each having an axis and including a multiplicity of spaced ridges defining the periphery of the corrugating members. The ridges have outer surfaces and define spaces between the ridges adapted to receive portions of ridges of the other corrugating member in meshing relationship with the sheet of flexible material therebetween. The ridges can be in the form of radial or longitudinally spaced parallel ridges or can be intersecting defining regular or irregular shapes with the ridges being linear, curved, continuous or intermittent. (2) The corrugating members are mounted in axially parallel relationship with portions of the opposing ridges in meshing relationship. (3) At least one of the corrugating members is rotated. (4) The sheet of flexible nonwoven material is fed between the meshed portions of the ridges to form the sheet of flexible nonwoven material on the periphery of one of the corrugating members. This forms arcuate portions of the sheet of flexible nonwoven material in the spaces between the ridges of a first corrugating member and anchor portions of the sheet of flexible nonwoven material along the outer surfaces of the ridges of the first corrugating member. (5) The formed sheet of flexible nonwoven material is retained along the periphery of the first corrugating member for a predetermined distance after movement past the meshing portions of the ridges. Following forming the arcuate nonwoven material, the inelastic strands are extruded in an extruding step which includes providing an extruder that, through a die with spaced die openings, extrudes the spaced strands of molten thermoplastic material onto the anchor portions of the sheet of flexible nonwoven material along the periphery of the first corrugating member within the above mentioned predetermined distance. The strand and nonwoven fabric composite is then oriented causing the strand material to undergo molecular orientation between the spaced apart bond sites.

The dimensions of the strands can be easily varied by changing the pressure in the extruder from which the strands are extruded (e.g., by changing the extruder screw speed or type); changing the speed at which the first corrugating member, and thereby the first sheet material, is moved (i.e., for a given rate of output from the extruder increasing the speed at which the sheet of flexible nonwoven material is moved will decrease the diameter of the strands, whereas decreasing the speed at which the sheet of nonwoven material is moved will increase the diameter of the strands); or changing the dimensions of the spaced die openings. The die through which the extruder extrudes the thermoplastic inelastic strand material can have an easily changeable die plate in which are formed the row of spaced openings through which the strands of molten thermoplastic material are extruded. Such interchangeable die plates, with openings of different diameters and different spacings, can be formed by electrical discharge machines or other conventional techniques. Varied spacing and/or diameters for the openings along the length of the die plates can be used to affect tensile strength at various locations across the composite, vary anchorage of the nonwoven material to the strands or increase surface area on the opposing elongate surface portion of the strands available for bonding the nonwoven fabric sheet to further substrates. The die can also be used to form hollow strands, strands with shapes other than round (e.g., square or + shaped) or bi-component strands.

The nonwoven fabric sheet can further include a second sheet of flexible nonwoven material having anchor portions thermally bonded at second bond sites. These second bond sites can also be longitudinally spaced along second elongate surface portions of the inelastic strands and have arcuate portions projecting from the second elongate surface portions of the inelastic strands between the second sheet bond sites.

Using the method described above, such a second sheet of flexible nonwoven material can also have arcuate portions. The second sheet of flexible nonwoven material arcuate portions can also project from spaced anchor portions of the second sheet of flexible nonwoven material. The spaced anchor portions of the second sheet of flexible nonwoven material are then positioned in closely spaced opposition to spaced anchor portions of the first sheet of flexible nonwoven material with the arcuate portions of the first and second sheets of flexible nonwoven material projecting in opposite directions. The spaced generally parallel elongate strands of molten thermoplastic inelastic strand material are then extruded between and onto the anchor portions of both the first and second sheets of flexible nonwoven material to form inelastic strands bonded to and extending between the anchor portions of both the first and second sheets of flexible nonwoven material.

In an alternative embodiment the spaced generally parallel elongate strands can be preformed and supplied onto the anchor portions along the periphery of the first corrugating member as described above. The corrugating member or a roll opposite the corrugating member, forming a nip, is heated so that the preformed strands are softened or melted and pressed against the anchor portions at the bond sites as described above. These preformed strands can be used in any of the contemplated embodiments of the invention where strands are provided by extrusion.

The composite nonwoven fabric sheets formed by the above described embodiments and elsewhere in this specification are then oriented or stretched in the longitudinal direction of the strands. This is preferably done while heating to soften the strands sufficient to allow orientation without strand breakage, particularly at the bond sites. This stretching causes molecular orientation to occur in the strand material preferably in the unbonded portions of the strands between the bond sites. The arcuate portions height becomes less as the distance between the bond sites increases due to the strand orientation. This can reduce or eliminate the projecting arcuate portions to create a substantially flat nonwoven fabric sheet with multiple oriented strengthened strands intermittently bonded to the nonwoven material along the length of the oriented strands. Preferably, the length of the flexible nonwoven material between the bond sites is substantially equal to the distance between the bond sites following the orientation step. This is done by stretching the composite nonwoven up to its allowable stretch(as defined in the examples), however the composite can be stretched beyond the allowable stretch provided that the bond sites to not orient significantly (e.g. more than 100 percent, preferably more than 50 percent).

Either or both of the first and second sheets of flexible nonwoven material(s) in the nonwoven fabric sheet can be a conventional web of nonwoven fibers or a multi-layer composite of nonwoven materials; for example carded webs, spunlaced webs, melt-blown webs, Rando webs, or laminates thereof. Also relatively strong nonwovens such as spunbond type webs or other highly consolidated webs can be used. The fibers forming the nonwoven material could be formed of natural or synthetic fibers such as polypropylene, polyethylene, polyester, nylon, cellulose, or polyamides, or combinations of such materials, such as a multicomponent fiber (e.g., a core/sheath fiber such as a core of polyester and a sheath of polypropylene which provides relatively high strength due to its core material and is easily bonded to polypropylene strands due to its sheath material). Fibers of different materials or material combinations may also be used in the same sheet of nonwoven material. One preferred type of nonwoven material having random arcuate portions is one where a fibrous web has been processed to have random arcuate portions by the "Microcreping Process for Textiles" using the "Micrex/Microcreper" equipment available from Micrex Corporation, Walpole, Mass., that bears U.S. Pat. Nos. 4,894,169; 5,060,349; and 4,090,385. In the microcreping process, the sheet of nonwoven material is randomly folded and compressed in a first direction along its surfaces. With a microcreped or like nonwoven web, the corrugating steps are not needed and the material can be directly joined to the thermoplastic strands. The anchor portions and arcuate portions are created by the microcreping processing.

Generally, sheets of flexible nonwoven material should be of polymeric material that can thermally bond with the thermoplastic strand material at the temperature of the extrudate or the bond temperature. Preferably, the sheets of nonwoven material and the thermoplastic strand material are formed from the same type of thermoplastic material to enhance bonding of the nonwoven material to the strands and also allowing for recycling. For example, in a preferred embodiment, the flexible nonwoven material would be formed in whole or in part of polypropylene fibers with the strands also formed of polypropylene allowing for increased anchorage between the strands and the fibers forming the flexible nonwoven material. Generally, both the strands and at least a portion of the flexible nonwoven material fibers are polyolefin materials, preferably compatible polyolefins.

Figure 2A:
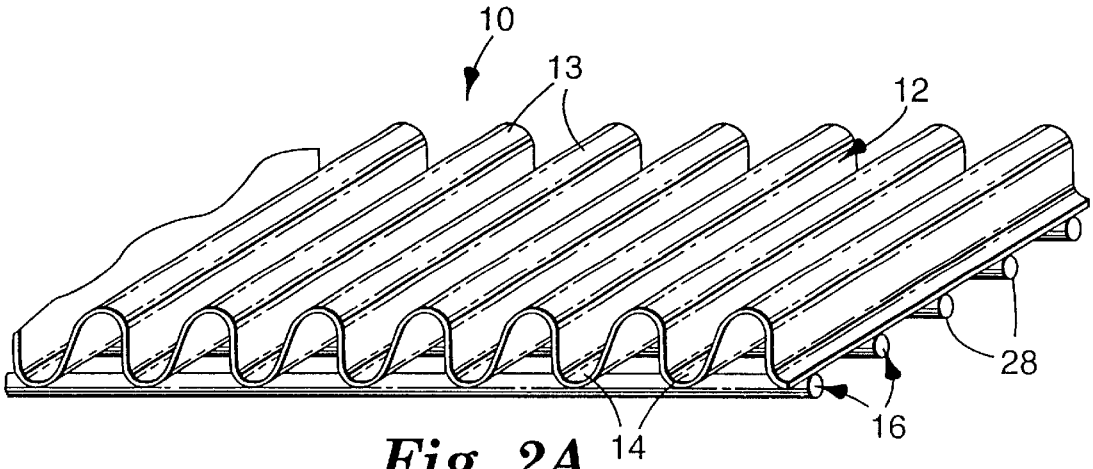
FIGS. 2A and 2B are perspective views 2A of a precursor material and 2B of the first embodiment of the nonwoven fabric sheet according to the present invention made by the method and equipment illustrated in FIG. 1.
Figure 2B:
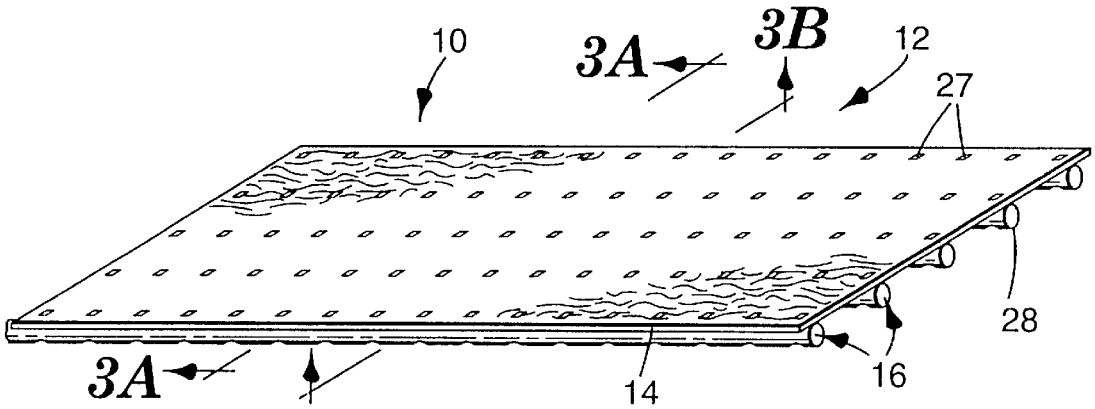
Figure 3A:
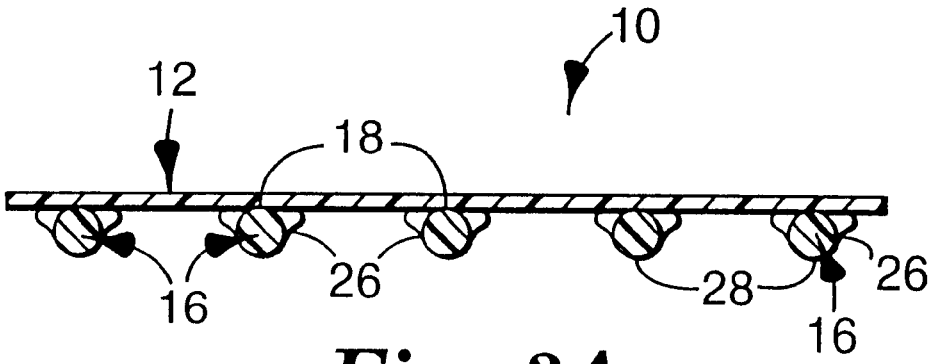
FIG. 3A is a fragmentary enlarged sectional view taken approximately along line 3A—3A of FIG. 2B.

FIG. 1 schematically illustrates a first embodiment of a method and equipment for making a first embodiment of a nonwoven fabric sheet 10 according to the present invention, which is illustrated in FIGS. 2B and 3.

Generally the method illustrated in FIG. 1 involves providing a first sheet 12 of flexible nonwoven material. The first sheet 12 of flexible nonwoven material is folded to have multiple arcuate portions 13 projecting in the same direction from spaced anchor portions 14 of the first sheet 12 of flexible nonwoven material. Spaced generally parallel elongate strands 16*a* of molten thermoplastic inelastic material are extruded onto the anchor portions 14 of the first sheet 12 of flexible nonwoven material to form inelastic strands 16.

The inelastic strands are thermally bonded to the anchor portions 14 forming bond sites and extend in the arcuate portion areas between the anchor portions 14 of the first sheet 12 of flexible nonwoven material. As such the multiple arcuate portions 13 of the first sheet 12 of flexible nonwoven material project from the elongate surface portions 18 of the strands 16 as shown in FIG. 2A. The strands are then cooled, solidified, and oriented to provide a high strength flexible nonwoven fabric sheet 10 as shown in FIG. 2B. The orientation step is generally done with applied heat to soften the strands during orientation. The arcuate portions 13 have been flattened due to the orientation of the strands 16 between roll 15 and roll 17, both of which may be driven. Roll 17 is overdriven relative to roll 15 to orient the nonwoven fabric sheet 10.

As illustrated in FIG. 1, equipment for performing the above method includes first and second generally cylindrical corrugating members 20 and 21 each having an axis and including a multiplicity of spaced ridges 19 defining the periphery of the corrugating members 20 or 21. The ridges 19 have outer surfaces with spaces defined between the ridges 19 adapted to receive portions of the ridges 19 of the opposing corrugating member in meshing relationship, with the first sheet 12 of flexible nonwoven material therebetween. A means is provided for mounting the corrugating members 20 and 21 in axially parallel relationship with portions of the ridges 19 in meshing relationship. A means is provided for rotating at least one of the corrugating members 20 or 21. A sheet 12 of flexible nonwoven material is fed by the rotating corrugating member(s) 20 or 21 between the meshed portions of the ridges 19 the sheet 12. The flexible nonwoven material will generally conform to the periphery of one of the corrugating members(e.g. 20). This forms the arcuate portions 13 of the first sheet 12 of flexible material in the spaces between the ridges 19 of this first corrugating member 20 and also forms the anchor portions 14 along the outer surfaces of the ridges 19 of the first corrugating member 20. There is also provided a means for retaining the formed sheet 12 of flexible material along the periphery of the first corrugating member 20 for a predetermined distance after the sheet has moved past the meshing portions of the opposing ridges 19. This means could include the surface of the first corrugating member 20 being roughened, e.g. by being sand blasted or chemically etched, or a vacuum, or being heated to a temperature above the temperature of the first sheet 12 of flexible nonwoven material, generally in the range of 25 to 150 Fahrenheit degrees above the nonwoven material temperature. An extruder feeds a die 22, which can be provided with a changeable die plate 23 (see FIG. 7) with spaced through openings 40. The extruder and die plate form a multiplicity of generally parallel elongate molten strands 16*a* of the thermoplastic material (e.g., polyester, polystyrene, polyolefin, nylons, coextruded materials or the like as discussed above) extending continuously in a generally parallel spaced relationship. The extruder and die are further positioned so that the molten strands 16*a* are extruded onto the anchor portions 14 of the first sheet 12 of flexible material along the periphery of the first corrugating member 20 within the above mentioned predetermined distance. Also, the equipment further includes a generally cylindrical cooling roll 24 having an axis with means for rotatably mounting the cooling roll 24 in axially parallel relationship with the corrugating members 20 and 21. The periphery of the cooling roll 24 is closely spaced from the periphery of the first corrugating member 20 defining a nip. At a second predetermined distance, there is a means provided (e.g., a nipping roller 25) for moving the nonwoven fabric sheet 10 for the second predetermined distance around the periphery of the cooling roll 24 past the nip. The strands 16 in this area contact the cooling roll 24 cooling and solidifying the strands 16. The nonwoven fabric sheet is then fed to an orienting station, which can be a idler roll 15 and a nipped driven roll 17 driven at a speed faster than that of cooling roll 24, to orient the strands 16 at least in the unbonded portion 11 between the bond sites 27. Alternatively, the nonwoven fabric sheet could be only selectively oriented in regions as disclosed in U.S. Pat. No. 5,424,025, the substance of which is incorporated by reference in its entirety.

The structure of the nonwoven fabric sheet 10 made by the method and equipment illustrated in FIG. 1 is best seen in FIGS. 2A, 2B, 3A and 3B. The nonwoven fabric sheet 10 comprises a multiplicity of generally parallel elongate strands 16 of inelastic thermoplastic material extending continuously in a generally parallel spaced relationship. Each of the strands 16 is generally cylindrical and has opposite elongate side surface portions 26 (See FIG. 3A) that are spaced from and are adjacent the elongate side surface portions 26 of adjacent strands. Each of the strands 16 also has corresponding opposite first and second elongate surface portions 18 and 28 extending between the opposite elongate side surface portions 26. The spaced anchor portions 14 of the sheet 12 of flexible nonwoven material are thermally bonded at sheet bond sites 27 to longitudinally spaced parts of the strands 16 along the first elongate surface portions 18. The flexible nonwoven material arcuate portions 13 have been flattened and contact, but are not bonded to, the first elongate surface portions 18 of the oriented inelastic strands 16 in the unbonded regions 11 between the first sheet bond sites 27.

Figure 3B:
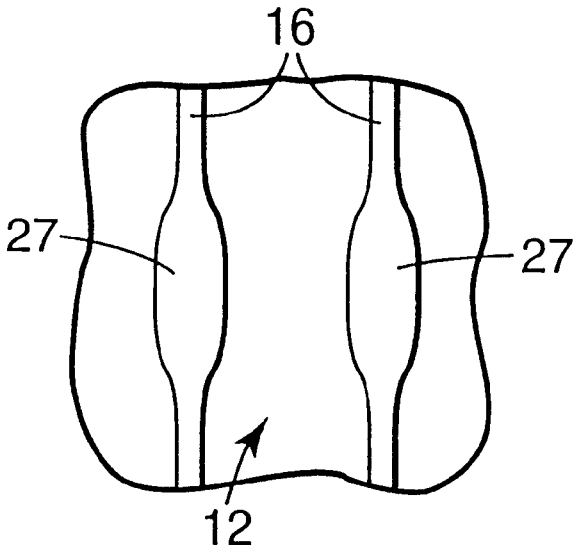
FIG. 3B is a fragmentary enlarged sectional view taken approximately along line 3B—3B of FIG. 2B.

In FIGS. 2A and 2B, the sheet bond sites 27 are spaced about the same distances from each other and aligned in generally parallel rows extending transverse of the strands 16. Because the strands 16 have been extruded in molten form onto the anchor portions 14 of the sheet 12 of flexible nonwoven material the strands can be pressed onto the anchor portions 14 of the sheet 12 by adjusting the nip spacing between the ridges 19 on the first corrugating member 20 and the periphery of the cooling roll 24. The compressed molten strands 16 can form around and are indented by the arcuate convex surfaces of the anchor portions 14. The bonds between the strands 16 and the anchor portions 14 at the first sheet bond sites 27 can extend outward depending on the compression of the molten strands at the anchor portion. As is illustrated in FIG. 3B, the strand surface at the bond site 27, that is closely adjacent the anchor portions 14, is widened by the indentations of the strands 16.

Figure 4:
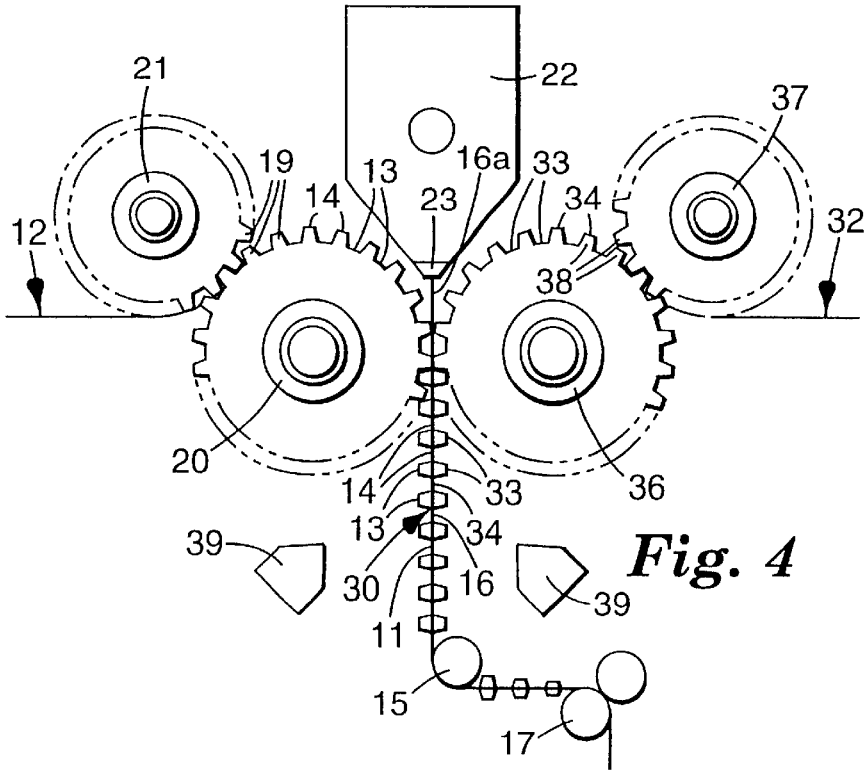
FIG. 4 is a schematic view illustrating a second-embodiment of a method and equipment for making a second embodiment of a nonwoven fabric sheet according to the present invention.
Figure 5:
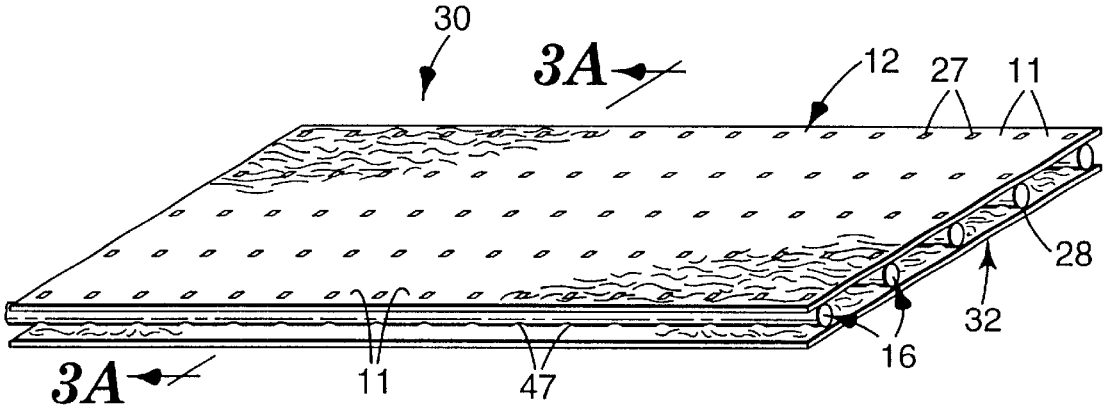
FIG. 5 is a perspective view of the second embodiment of the nonwoven fabric sheet according to the present invention made by the method and equipment illustrated in FIG. 4.
Figure 6:
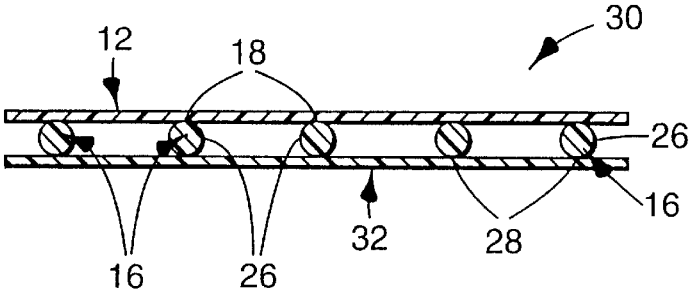
FIG. 6 is a fragmentary enlarged sectional view taken approximately along line 6—6 of FIG. 5.

FIG. 4 illustrates a second embodiment of a method and equipment for making a second embodiment of a nonwoven fabric sheet 30 according to the present invention, which sheet 30 is illustrated in FIGS. 5 and 6. The method illustrated in FIG. 4 is somewhat similar and uses much of the same equipment as is illustrated in FIG. 1, and similar portions of that equipment have been given the same reference numerals and perform the same functions as they do in the equipment illustrated in FIG. 1. In addition to the general method steps described above with reference to FIG. 1, the method illustrated in FIG. 4 further generally includes the steps of providing a second sheet of nonwoven material 32. The second sheet 32 of nonwoven material is formed to have multiple arcuate portions 33 projecting in the same direction from spaced anchor portions 34 of the second sheet 32 of nonwoven material. The spaced anchor portions 34 of the second sheet 32 of nonwoven material are positioned in closely spaced opposition to the spaced anchor portions 14 of the first sheet 12 of flexible nonwoven material with the arcuate portions 13 and 33 of the first and second sheets 12 and 32 of nonwoven material projecting in opposite directions. The extruder die 23 extrudes the spaced generally parallel elongate strands 16*a* of molten thermoplastic inelastic material between and onto the anchor portions 14 and 34 of both the first and second sheets 12 and 32 of nonwoven material to form inelastic strands 16 bonded to and extending between the anchor portions 14 and 34 of both the first and second sheets 12 and 32 of nonwoven material. The arcuate portions 13 and 33 of the first and second sheets 12 and 32 of nonwoven material project in opposite directions from opposite corresponding first and second elongate surface portions 18 and 28 of the strands 16 prior to orientation of the fabric sheet which flatten the arcuate portions between the bond sites created at the anchor portions.

The equipment illustrated in FIG. 4, in addition to the first and second corrugating members 20 and 21, and the extruder 22, which are operated in the manner described above with reference to FIG. 1, further includes third and fourth generally cylindrical corrugating members 36 and 37 which operate as described above relative to corrugating members 20 and 21. The third corrugating member 36 is positioned in spaced relationship from the first corrugating member 20 so that the extruder die 22 positions the molten strands 16*a* on the anchor portions 14 and 34 of both the first and second sheets 12 and 32 of loop material along the peripheries of the first and third corrugating members 20 and 36 within the above mentioned predetermined distance. Air ducts 39 are provided to blow streams of cool air against opposite sides of the nonwoven fabric sheet 30 to solidify the strands 16*a* and the bond between the strands 16*a* and the anchor portion 14 and 34 of the sheets 12 and 32. The solidified fabric sheet is then oriented between idler roll 15 and nipped driven roll 17 to orient the strands at least in the unbonded regions 11 between bond sites 27 and 47 as described relative to the first embodiment method and equipment illustrated in FIG. 1.

The structure of the second embodiment nonwoven fabric sheet 30 made by the method and equipment illustrated in FIG. 4 is best seen in FIGS. 5 and 6. The nonwoven fabric sheet 30 comprises the multiplicity of generally parallel elongate strands 16 of inelastic thermoplastic material extending in generally parallel spaced relationship. Each of the strands 16 has opposite elongate side surface portions 26 (See FIG. 6) that are spaced from and are adjacent the elongate side surface portions 26 of adjacent strands. Each of the strands 16 also has corresponding opposite first and second elongate surface portions 18 and 28 extending between its opposite elongate side surface portions 26. The spaced anchor portions 14 of the first sheet 12 of flexible nonwoven material are thermally bonded at first sheet bond sites 27 to longitudinally spaced parts of the strands 16 along their first elongate surface portions 18, and the arcuate portions 13 of the first sheet 12 of flexible material are flattened in the unbonded region 11 where the strands have been elongated. The second sheet 32 of nonwoven material has its spaced anchor portions 34 thermally bonded at second spaced sheet bond sites 47 to longitudinally spaced parts of the strands 16 along the second elongate surface portions 28, and has its arcuate portions 33 flattened in the unbonded region 11 where the strands have been elongated. The first and second sheet bond sites (27 and 47) are opposed to each other, are spaced about the same distances from each other, and are aligned in generally parallel rows extending transverse of the strands 16. Because the strands 16 have been extruded in molten form onto the anchor portions 14 and 34 of both the first and second sheets 12 and 32, the molten strands 16 can form around and be indented on opposite elongate surface portions by the arcuate convex adjacent surfaces of the anchor portions 14 and 34. The bonds between the strands 16 and the anchor portions 14 and 34 at the first and second sheet bond sites (27 and 47) as above can extend outward in the area adjacent the anchor portions 14 and 34 as shown in FIG. 3B.

Alternative structures that could be provided for the nonwoven fabric sheet 30 (in addition to the alternate structures noted above for the nonwoven fabric sheet 10) include spacing the anchor portions 14 of the first sheet 12 and the anchor portions 34 of the second sheet 32 at different spacings along the strands 16 and/or causing the continuous rows of the arcuate portions 13 and 33 to project at different distances from the first and second elongate surface portions 18 and 28 of the strands 16; or causing one of the sheets 12 or 32 to be discontinuous along its length, or across its width.

Figure 7:
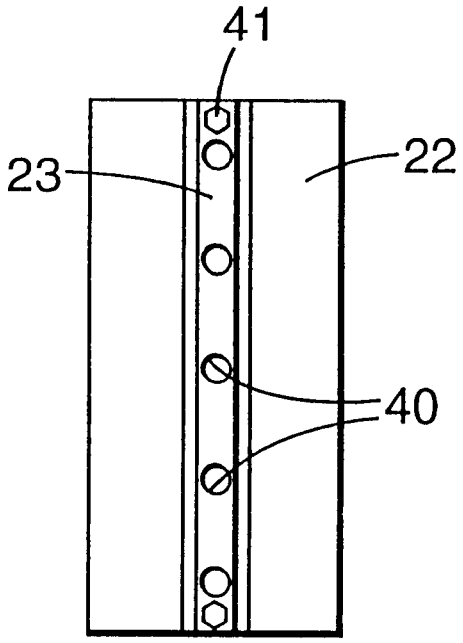
FIG. 7 is a fragmentary front view of a die plate included in the equipment illustrated in FIGS. 1 and 4.

FIG. 7 illustrates the face of the die 22 through which the molten strands 16*a* of thermoplastic material are extruded. The die 22 has spaced openings 40 (e.g., 0.762 millimeter or 0.03 inch diameter openings spaced 2.54 millimeter or 0.1 inch center to center) in its die plate 23 preferably formed by known electrical discharge machining techniques. The die plate 23 is retained in place by the bolts 41, and can be easily replaced with a die plate with openings of different or varied sizes, which openings are spaced on different or varied centers to produce a desired pattern of strands from the die 22.

Figure 8:
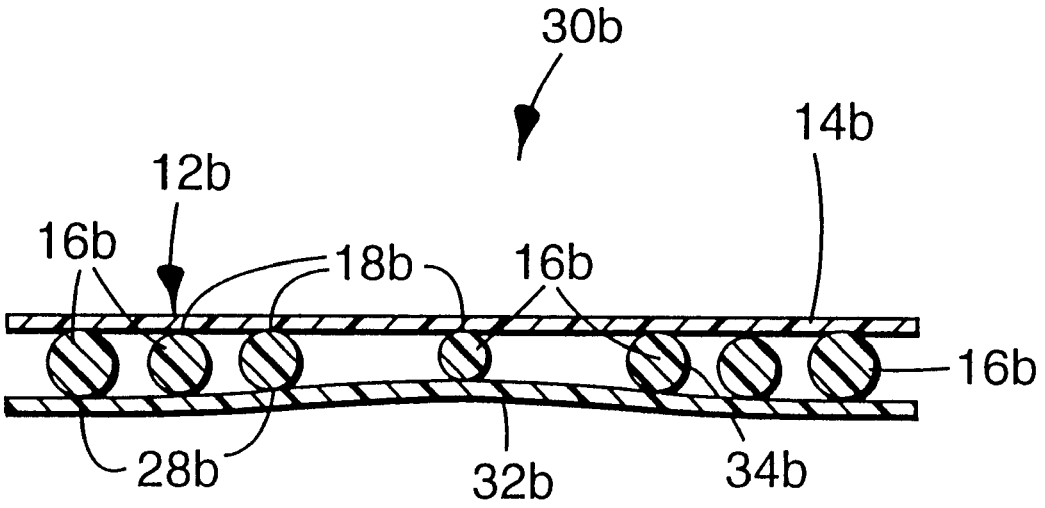
FIG. 8 is a fragmentary sectional view similar to that of FIG. 6 which illustrates possible variations in the size and spacing of strands included in the nonwoven fabric sheet.

FIG. 8 illustrates a nonwoven fabric sheet 30*b* similar to that illustrated in FIGS. 5 and 6 and in which similar parts are identified with similar reference numerals except for the addition of the suffix "b". FIG. 8 shows one of many possible variations in the spacing and diameters of the strands 16*b*. The strands can be round, square, rectangular, oval, or any other shape. The elongate surface portions of the strands attached to the oriented nonwoven sheet material generally comprises from 2 to 70 percent of the cross sectional surface area of the nonwoven fabric sheet, preferably 5 to 50 percent. This permits sufficient surface area for the nonwoven fabric sheet to be further attached to a substrate and still have the required tensile strength as well as breathability, flexibility, and other bulk properties of the nonwoven material.

Generally, the nonwoven fabric sheet should have a tensile strength in the lengthwise direction of the strands of at least 2000 grams/2.54 cm-width, preferably at least 4000 gram/2.54 cm-width. Low tensile strengths decrease dimensional stability.

Figure 9:
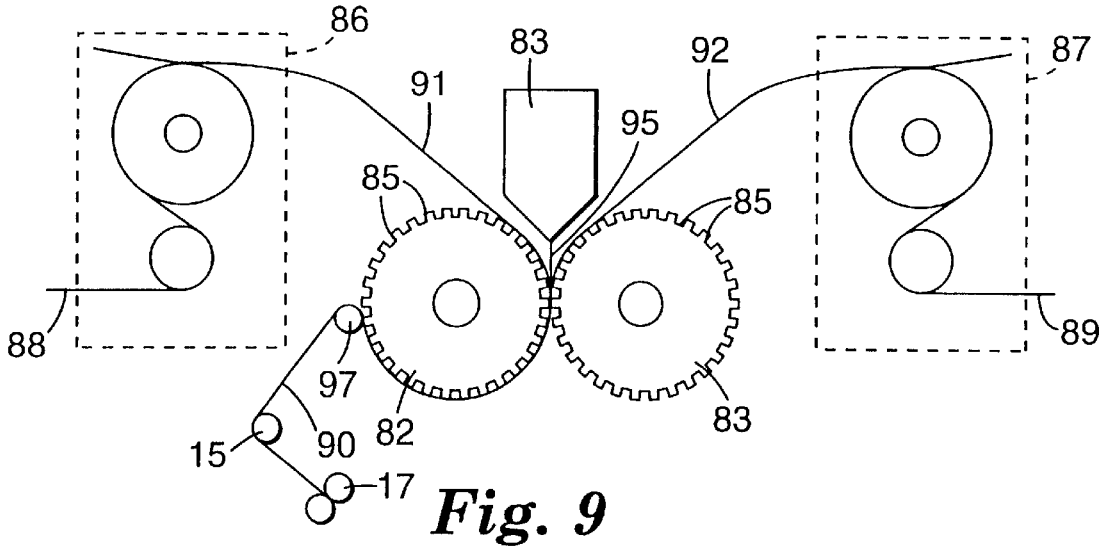
FIG. 9 is a schematic view illustrating a third embodiment of a method and equipment for making a third embodiment of the nonwoven fabric sheet according to the present invention.
Figure 10:
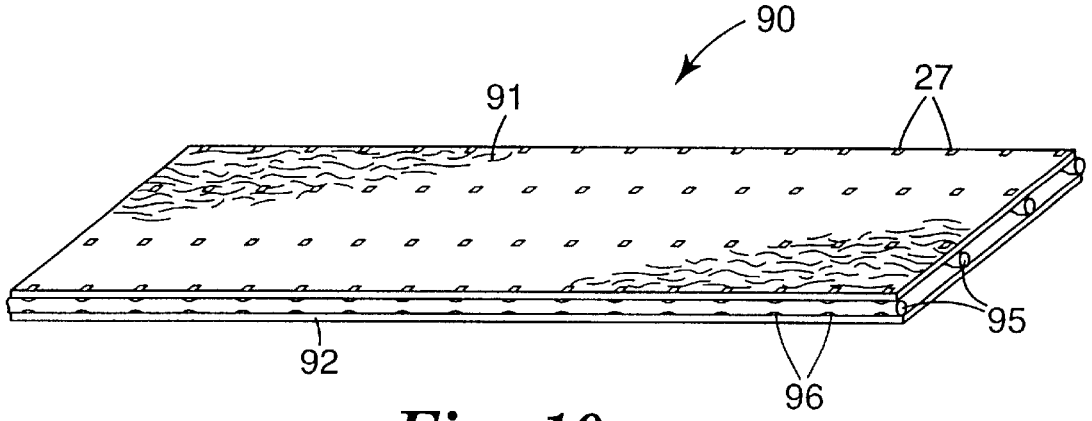
FIG. 10 is a perspective view of the third embodiment of a nonwoven fabric sheet according to the present invention made by the method and equipment illustrated in FIG. 9.
Figure 11:
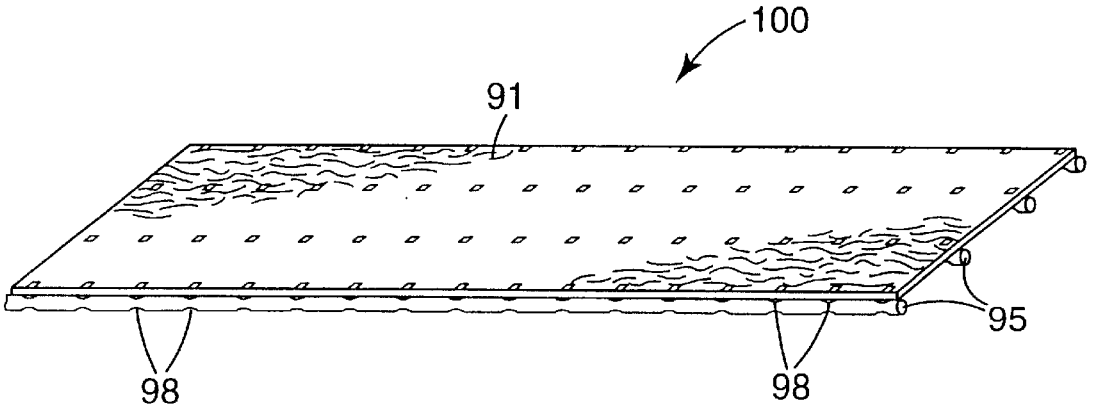
FIG. 11 is a perspective view of a fourth embodiment of a nonwoven fabric sheet according to the present invention that can be made by the method and equipment illustrated in FIG. 9.

FIG. 9 illustrates a third embodiment of a method and equipment that can be used for making third and fourth embodiments of nonwoven fabric sheet 90 and 100 according to the present invention, respectively illustrated in FIGS. 10 and 11.

The equipment illustrated in FIG. 9 includes first and second generally cylindrical bonding rollers 82 and 83 each having an axis and a periphery around that axis defined by circumferentially spaced ridges 85 generally parallel to the axes of the bonding rollers 82 and 83. The bonding rollers 82 and 83 define a nip. Compacting devices 86 and 87 (e.g., the devices commercially designated "Micrex/Microcreper" equipment available from the Micrex Corporation, Walpole, Mass., which crinkles and compresses the fibers or material of a sheet to form a sheet that is compacted in a first direction along its surfaces)are adapted for receiving a sheet 88 or 89 of flexible nonwoven material having opposite major surfaces. These compacting devices compact sheet 88 or 89 in a first direction parallel to its major surfaces (i.e., along its direction of travel through the device 86 or 87) so that the first and second compacted sheets 91 and 92 have opposite surfaces and can be extended in the first direction along those surfaces in the range of 1.1 to over 4 times its compacted length in the first direction. Means are provided for feeding the first and second compacted sheets 91 and 92 of flexible nonwoven material into the nip formed by the first and second bonding rollers 82 and 83. An extruder 83 that is essentially the same as the extruder 22 described above, extrudes inelastic thermoplastic material strands in generally parallel spaced relationship and are positioned between the opposed surfaces of the first and second compacted sheets 91 and 92 of flexible material in the nip between the first and second bonding rollers 82 and 83. The strands 95 extending in the first direction along the first and second compacted sheets 91 and 92 are thermally bonded to the first and second compacted sheets 91 and 92 at spaced bond sites 96 along the strands 95 because of bonding pressure applied by the ridges 85. The nonwoven fabric sheet 90 is retained along the periphery of the bonding roller 82 by a guide roller 97, and the bonding roller 82 is cooled (e.g., to 100 degrees Fahrenheit) to help solidify the strands 95. The nonwoven fabric 10 is oriented between idler roll 15 and nipped driven roll 17 as described relative to the first embodiment of FIG. 1.

The nonwoven fabric sheet 90 made by the mechanism illustrated in FIG. 9 is illustrated in FIG. 10. That nonwoven fabric sheet 90 comprises a multiplicity of the generally parallel elongate extruded strands 95 of inelastic thermoplastic material extending in generally parallel spaced relationship. Each of the strands 95 having opposite elongate side surface portions that are spaced from and are adjacent the elongate side surface portions of adjacent strands 95, and each of the strands 95 also having corresponding opposite first and second elongate surface portions extending between the opposite elongate side surface portions. The first and second compacted and extended sheets 91 and 92 of flexible nonwoven material have opposite major surfaces. Those first and second compacted and extended sheets 91 and 92 are respectively thermally bonded to the first and second elongate surface portions of the strands 95 at the closely spaced bond sites 96.

The equipment illustrated in FIG. 9 can be operated with only one of the sheets 88 or 89 of flexible nonwoven material, in which case it will make a nonwoven fabric sheet like the nonwoven fabric sheet 100 illustrated in FIG. 11. Alternatively, one of the sheets of nonwoven material 88 or 89 in the FIG. 9 equipment could be replaced by a spunlace scrim 99, or like low loft orientable breathable material which could be fed without feeding through a compacting device 86 or 87.

The strand 16 illustrated in the above embodiments are essentially continuous and parallel in the longitudinal or machine direction of the composite nonwoven material. Additionally, the strands could extend substantially non-parallel, each with respect to the other provided that the overall web inextensibility is not significantly effected. Further, the arcuate portions of the sheet flexible material formed by the methods illustrated above could be in the form of circles, diamonds, rectangular shapes or other regular or irregular patterns through the use of suitable intermeshing corrugating members with rigid elements. Preferably, the bond sites of the anchor portions are spaced each from the other along the length of the inelastic strand materials by a distance of on average 2 mm to 200 mm, preferably, 5 mm to 100 mm prior to orientation and from 4 to 1000 mm, preferably 5 to 500 mm after orientation of the composite sheet material.

The inelastic strands 16 could also be provided as preformed strands which could be unwound from multiple bobbins or other wound rolls and fed into a comb or like structure to distribute the strands along the width of a heated nip which would thermally bond the preformed inelastic strands to the flexible nonwoven material. For example, in the embodiment depicted in FIG. 1, the ridge members 19 on the first corrugating member 20 could be heated or serve as an anvil for an ultrasonic bonder to thermally point bond the preformed strands to the anchor portions of the flexible nonwoven material 12.

With any of the above described embodiments, additional layers could be incorporated. For example, in the embodiment depicted in FIG. 9, either of compacting devices 87 or 86 could be omitted, instead replaced by providing an uncompacted sheet of film or a variety of easily extensible material including lightly bonded extensible non-woven webs. These additional web materials could also be printed on one or both side to provide suitable aesthetic or informational messages. Printing could also be performed on the formed nonwoven fabric sheet by printing the flexible nonwoven material on either surface, either before or after it is attached to the inelastic strand material 16.

Figure 12:
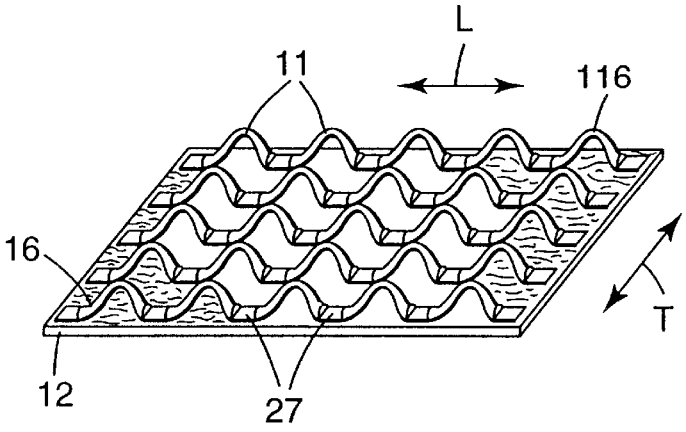
FIG. 12 is a perspective view of a fifth embodiment of a nonwoven fabric sheet such as formed by the first embodiment stretched in the transverse direction.

In the embodiment of FIG. 12, the material of FIG. 2B has been stretched transverse(T) to the longitudinal direction(L) of the oriented inelastic strand 16. This results in the nonwoven material contracting in the longitudinal direction (L) by necking. The strands 16 as such are buckled between the spaced anchor portions bond sites 27 causing the strands to bend outward in the unbonded regions 11. The strand 16 length between the bond sites is greater than the length of the compacted or contracted flexible nonwoven between the bond sites. These bent loop portions 116 provide upstanding projections extending from the surface of the substantially flat flexible nonwoven 12. These strand projections 116 can be used to create a spacer element to separate the nonwoven material 12 from a surface in which the composite is in contact. The strand projections can also provide a material with significant loft or can engage with suitable mechanical fastener elements. The nonwoven material for this embodiment must be neckable, meaning that it must shrink in size in the direction transverse to the direction in which it is elongated. Suitable neckable nonwoven webs include spunbond webs, bonded carded webs, melt blown fiber webs and the like.

The composite nonwoven material of the invention finds particular advantageous use as medical wraps, interliners, absorbents, geotextiles, wipes, or the like. The material has high strength in the machine direction yet still retains its breathable nature and its conformability in both the cross and machine direction. The orientation step results in molecular orientation of the molecules of the inelastic strand material thereby significantly enhancing the tensile strength of the composite. The phenomenon of molecular orientation upon orienting is well understood. Since the fibrous portions are arcuate prior to orientation they do not undergo substantial deformation during the orienting step if the level of orientation is maintained to the extent where the arcuate portions are rendered substantially flat. The nonwoven material can easily flex and conform and withstand flexural forces. The invention process actually decreases the percent bond area increasing the permeability and openness In a particular preferred embodiment, the nonwoven fabric sheet material could be supplied in a roll form cut into appropriate shapes on a continuous production line and integrated into an assembly with suitable attachment methods including ultrasonic bonding, heat bonding, hot melt, or pressure sensitive adhesive attachment.

Generally, it is desirable to have the bond sites stretch less than 100 percent and most preferably less than 50 percent. With relatively higher strength (e.g., strengthen by calandering or like bonding) nonwovens it is possible to have the bond site stretch by less than 5 percent (e.g., spunbonded nonwovens). The strand material between the bond sites is generally oriented at least 15 percent, preferably at least 50 percent, and most preferably at least 90 percent, resulting in molecular orientation of the strand thermoplastic material. The strand material between the bond sites should be significantly more oriented than the strand material at the bond sites. Generally at least 15 percent more, most preferably at least 50 percent more.

EXAMPLES

Example 1

An inelastic fabric sheet composite similar to the sheet-like composite 10 illustrated in FIG. 2A was made using equipment similar to that illustrated in FIG. 1. A thermoplastic ethylene-propylene impact copolymer commercially available under the designation 7C50 from the Union Carbide Corporation of Danbury, Conn. was placed in the extruder 22 to form substantially parallel inelastic strands 16 at approximately 4.7 strands per cm. The strands, at a basis weight of 40 grams per square meter, were applied by the equipment to a corrugated first sheet 12 of carded nonwoven material formed from 6 denier polypropylene staple fibers commercially available under the designation J01 from Amoco Fabric and Fibers Company of Atlanta, Ga. The carded nonwoven sheet had a basis weight of 55 grams per square meter after corrugation. The nonwoven sheet 12 was corrugated in the cross direction between the corrugation rollers 20 and 21 to form approximately 3 linear corrugations per centimeter, then bonded to the extruded strands 16 in the nip between the corrugation roll 20 and the chill roll 24. The corrugation roll 20 was at about 93° C.; the corrugation roll 21 was at about 149° C., and the chill roll 24 was at about 21° C. The line speed was about 18 meters per minute, and the melt temperature in the extruder 22 was about 260° C. The resulting inelastic nonwoven fabric sheet composite produced had arcuate nonwoven portions 13 about 2 mm in height projecting from the strands.

Figure 13:
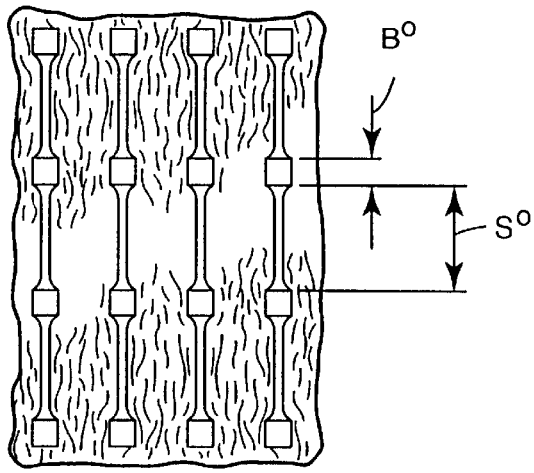
FIGS. 13 and 14 are both plane views of the first embodiment nonwoven fabric of FIGS. 2A and 2B, respectively.
Figure 14:
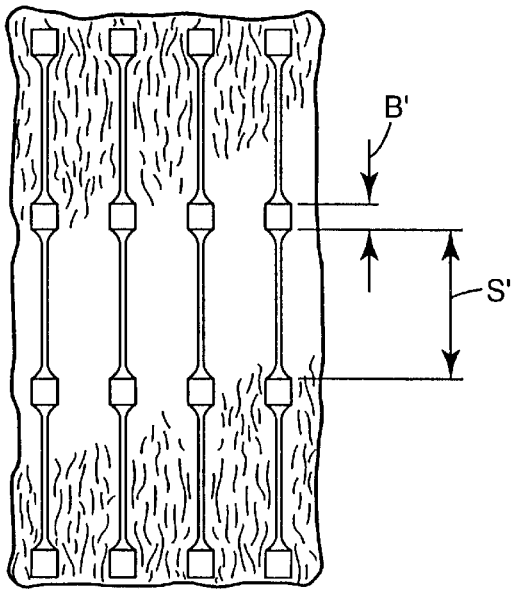

The strands 16 between the bond sites were then oriented longitudinally with application of heat and tension. A 7.6-cm wide by 10.2-cm long sample was stretched approximately 91% while being heated with a Master Heat Gun Model HG-751B available from the Master Appliance Corp. of Racine, Wis. to soften the inelastic strands. The heat gun was set on high and held approximately 25 centimeters from the sample while it was being stretched. The temperature of the hot air during stretching was approximately 50° C., as measured with a thermometer held in close proximity to the sample. During the stretching operation, the inelastic strands between the bond sites orient longitudinally resulting in the arcuate nonwoven portions being rendered flat as shown in FIG. 2B. The strands do not orient in the bond site regions to any appreciable extent providing the strands are not stretched beyond the point where the arcuate nonwoven portions are rendered flat, also referred to as percent (%) allowable stretch. The percent allowable stretch of the nonwoven fabric composite before the strand orientation step, was calculated by measuring the arc length $A_o$ of the arcuate nonwoven portions between two bond sites of the nonwoven fabric sheet composite, subtracting the length of the strand between the two bond sites $S_o$ from the result, dividing the result by the length of the strand $S_o$ between the two bond sites, and then multiplying by 100 to convert the result to a percentage. The percent orientation or stretch was calculated by measuring the lengths of the inelastic strands between the bond sites $S_o$ and S', before and after orientation. The increase in strand length was divided by the original unoriented strand length and the result multiplied by 100 to convert to a percentage. Percent orientation and percent available stretch are shown in Table 1 below. The lengths of the bonding sites $B_o$ and B', shown in FIGS. 13 and 14, were also measured before and after stretching to determine if the composite had been stretched beyond the point where the arcuate nonwoven portions are rendered flat. The results are shown in Table 2 below. Following the longitudinal orientation, the oriented composite was tested for tensile strength as described in "Test Methods" below. The data obtained is shown in Table 3.

Example 2

An inelastic nonwoven fabric sheet composite was prepared similar to the composite in Example 1 except 30 denier polypropylene staple fibers commercially available under the designation J01 from Amoco Fabric and Fibers Company of Atlanta, Ga. were used to form the corrugated nonwoven sheet at a basis weight of 55 grams per square meter. A strand count of 9.4 strands per centimeter at a basis weight of 50 grams per square meter was used. The inelastic sheet-like composite produced had arcuate nonwoven portions 13 about 1.6 mm in height projecting from the strands. The strands between the bond sites were then oriented approximately 92% using the same procedure as in Example 1. The lengths of the bonding sites were also measured before and after stretching. The inelastic composite was tested for tensile strength before and after the orientation step.

Comparative Example 1

An inelastic nonwoven fabric sheet-like composite was prepared as in Example 2 and the strands between the bond sites oriented using the same procedure as in Example 1 except the strands were oriented approximately 330% to demonstrate the effect of stretching the composite significantly beyond the point where the arcuate nonwoven portions are rendered flat. This material has high tensile strength due to the high level of orientation in the strands, however the bond sites have stretched considerably also (approximately 130%) resulting in unbonded, minimally bonded and/or broken fibers which compromise web integrity, homogeneity and appearance. Once the bond areas are reduced substantially due to orienting, the fibers have minimal anchorage and the composite has an undesirable nonuniform appearance. The lengths of the bonding sites were also measured before and after stretching. The composite was tested for tensile strength before and after the orientation step.

Example 3

An inelastic nonwoven fabric sheet-like composite was prepared as in Example 1 except 18 denier polypropylene staple fibers commercially available under the designation J01 from Amoco Fabric and Fibers Company of Atlanta, Ga. were used to form the corrugated nonwoven sheet. A strand count of 9.4 per cm was used at a basis weight of 50 grams per square meter. The corrugation periodicity was approximately 4 corrugations per centimeter. The sheet-like composite produced had arcuate nonwoven portions about 1.60 mm in height projecting from the strands. The strands between the bond sites were then oriented approximately 104% using the same procedure as in Example 1. The lengths of the bonding sites were also measured before and after stretching. The inelastic composite was tested for tensile strength before and after the orientation.

Example 4

An inelastic nonwoven fabric sheet-like composite was prepared as in Example 1 except a 30 grams per square meter basis weight spunbonded type polypropylene nonwoven available from Amoco Fabrics and Fibers Company of Atlanta, Ga., under the designation 'RFX' was used in place of the carded nonwoven web. A strand count of 9.4 strands per cm was used at a basis weight of 50 grams per square meter. The sheet-like composite produced had arcuate nonwoven portions about 2.0 mm in height projecting from the strands. The strands between the bond sites were then oriented approximately 100% using the same procedure as in Example 1. The lengths of the bonding sites were also measured before and after stretching. The composite was tested for tensile strength before and after the orientation.

Example 5

An inelastic nonwoven fabric sheet-like composite was prepared as in Example 1 except hexagonal pattern embossing rolls were used in place of the corrugating rolls as described in PCT Application No. WO 98/06290. 18 denier polypropylene staple fibers commercially available under the designation J01 from Amoco Fabric and Fibers Company of Atlanta, Ga. were used to form the carded nonwoven into which a hexagonal pattern was embossed with each side of the hexagon being approximately 3 mm long. A strand basis weight of 50 grams per square meter was used. The sheet-like composite produced had arcuate nonwoven portions about 1.34 mm in height projecting from the strands. The strands between the bond sites were then oriented using the same procedure as in Example 1. The composite was tested for tensile strength before and after the orientation step.

Example 6

An inelastic nonwoven fabric sheet-like composite was prepared as in Example 4 and then the strands between the bond sites were oriented approximately 100% using the same procedure as in Example 1. The resulting oriented composite was then stretched 10% in the transverse or cross direction which resulted in the oriented strands 11 being projected upwards from the nonwoven layer to form arcuate portions approximately 0.85 mm in height as shown in FIG. 12.

TEST METHODS

To evaluate the tensile strength of the inelastic composites of this invention, tensile testing was performed using a modified version of ASTM D882 with an Instron Model 5500R constant rate of extension tensile machine. A sample was cut from the composite, 2.54 cm wide by 10.16 cm long, the long direction being in the machine or longitudinal direction. The sample was mounted in the jaws of the test machine with an initial jaw separation of 2.54 cm. The jaws were then separated at a rate of 5 cm/min and the yield point recorded.

Three replicates were tested and averaged for each test result.

TABLE 1

| Example | Strand length before orientation $S_o$ (mm) | Strand length after orientation S' (mm) | Percent Orientation $[(S' - S_o)/S_o] \times 100$ | Percent Allowable Stretch $[(A_o - S_o)/S_o] \times 100$ |
|---|---|---|---|---|
| 1 | 2.85 | 5.44 | 91% | 84% |
| 2 | 2.67 | 5.13 | 92% | 115% |
| Comp. 1 | 2.67 | 11.43 | 328% | 115% |
| 3 | 2.04 | 4.17 | 104% | 88% |
| 4 | 2.37 | 4.75 | 100% | 96% |
| 5 | 4.87 | 5.69 | 17% | 31% |

TABLE 2

| Example | Bond site length before orientation $B_o$ (mm) | Bond site length after orientation B' (mm) | Percent Bond site stretch $[(B' - B_o)/B_o] \times 100$ |
|---|---|---|---|
| 1 | 0.81 | 1.15 | 42% |
| 2 | 0.88 | 1.33 | 51% |
| Comp. 1 | 0.88 | 2.02 | 130% |
| 3 | 0.68 | 0.93 | 37% |
| 4 | 1.04 | 1.04 | 0.0% |
| 5 | 0.69 | 1.26 | 83% |

TABLE 3

| Example | Yield tensile strength before orientation (grams/25.4 mm) | Yield tensile strength after orientation (grams/25.4 mm) | Percent increase in yield tensile strength |
|---|---|---|---|
| 1 | 1640 | 2960 | 81% |
| 2 | 2010 | 3810 | 90% |
| Comp. 1 | 2010 | 5310 | 164% |
| 3 | 1890 | 2770 | 47% |
| 4 | 2530 | 4950 | 96% |
| 5 | 1890 | 2760 | 46% |

What is claimed is:

1. A nonwoven fabric sheet comprising:

a multiplicity of generally parallel elongate strands of inelastic thermoplastic material extending in a first direction in spaced relationship, each of said strands having opposite elongate side surface portions that are spaced from and are adjacent elongate side surface portions of adjacent strands, and each of said strands also having corresponding opposite first and second elongate surface portions extending between said opposite elongate side surface portions; and a first sheet of flexible nonwoven material formed of fibers, having spaced anchor portions bonded at first bond sites of the strands along said first elongate surface portions wherein the thermoplastic material forming the strands is oriented by stretching the strands at least between adjacent bond sites along the length of the strands.

2. The nonwoven fabric sheet of claim 1 where the nonwoven fabric sheet has a tensile yield strength in the first direction of at least 2000 grams/2.54 cm-width.

3. The nonwoven fabric sheet of claim 1 wherein the nonwoven fabric sheet has a second web attached to the second elongate surface portion.

4. The nonwoven fabric sheet of claim 1 wherein the nonwoven fabric sheet has a tensile yield strength in the first direction of at least 4000 g/2.54 cm-width.

5. The nonwoven fabric sheet of claim 1 wherein the strands at the bond sites are less oriented than the strands between the bond sites.

6. The nonwoven fabric sheet of claim 1 wherein the bond sites are from 2 to 70 percent of the nonwoven fabric sheet cross sectional area.

7. The nonwoven fabric sheet of claim 1 wherein the strands at the bond sites are oriented by less than 100 percent.

8. The nonwoven fabric sheet of claim 7 wherein strands at the bond sites are oriented by less than 5 percent.

9. The nonwoven fabric sheet according to claim 1 having regions with oriented strand and adjacent regions without oriented strands.

10. The nonwoven fabric sheet according to claim 1 wherein the strand length between the bond sites is greater than the length of the flexible nonwoven material between the bond sites creating upstanding strand loop portions.

11. The nonwoven fabric sheet according to claim 8 wherein said strands have a greater width between said opposite elongate side surface portions at said first sheet bond sites.

12. The nonwoven fabric sheet according to claim 1 wherein the strands and at least some of the fibers forming the flexible nonwoven material are formed of a polyolefin.

13. A disposable diaper or other garment including a nonwoven fabric sheet, the nonwoven fabric sheet comprising:

a multiplicity of generally parallel elongate strands of inelastic thermoplastic material extending in spaced relationship, each of said strands having opposite elongate side surface portions that are spaced from and are adjacent elongate side surface portions of adjacent strands, and each of said strands also having corresponding opposite first and second elongate surface portions extending between said opposite elongate side surface portions; and a first sheet of flexible nonwoven material having anchor portions thermally bonded at first sheet bond sites of the strands along said first elongate surface portions wherein thermoplastic material forming the elongate strands is oriented at least between adjacent bond sites along the length of the strands.

* * * * *